United States Patent [19]

Lilly

[11] Patent Number: 4,554,889

[45] Date of Patent: Nov. 26, 1985

[54] HYBRID PREHEAT/RECIRCULATING STEAM GENERATOR

[75] Inventor: Gerard P. Lilly, Plum Borough, Pa.

[73] Assignee: Westinghouse Electric Corp., Pittsburgh, Pa.

[21] Appl. No.: 623,682

[22] Filed: Jun. 22, 1984

[51] Int. Cl.[4] ..... F22B 1/02

[52] U.S. Cl. ..... 122/32; 122/34

[58] Field of Search ..... 122/32, 34; 165/112

[56] References Cited

U.S. PATENT DOCUMENTS

| | | | |
|---|---|---|---|
| 1,894,782 | 1/1933 | Muller . | |
| 2,276,780 | 3/1942 | Johansson . | |
| 2,849,989 | 9/1958 | Vorkauf . | |
| 3,804,069 | 4/1974 | Bennett . | |
| 3,896,770 | 7/1975 | Byerley et al. . | |
| 3,916,843 | 11/1975 | Bennett . | |
| 4,037,569 | 7/1977 | Bennett et al. . | |
| 4,089,304 | 5/1978 | Beckmann . | |
| 4,208,987 | 6/1980 | Chaix et al. | 122/32 |
| 4,357,908 | 11/1982 | Yazidjian | 122/32 |

*Primary Examiner*—Edward G. Favors

*Attorney, Agent, or Firm*—R. P. Lenart

[57] ABSTRACT

A hybrid preheat/recirculating steam generator is provided with a divided downcomer such that cold feedwater is preheated by being mixed with recirculating water and the mixture is introduced on the cold leg side of the tube bundle by natural circulation. A partition plate between the hot leg and cold leg sides of the tube bundle keeps the mixture on the cold leg side from mixing with the remainder of the recirculating water which enters on the hot leg side of the bundle in the usual manner.

4 Claims, 3 Drawing Figures

HYBRID PREHEAT/RECIRCULATING STEAM GENERATOR

BACKGROUND OF THE INVENTION

This invention relates to steam generators for nuclear power plants and more particularly to such steam generators which utilize recirculated liquid to preheat incoming liquid.

In a steam generator utilizing a first heated fluid to convert a second fluid to steam, the pressure of the steam is a function of the logarithmic means temperature difference (LMTD) between the two fluids. Thus, by increasing the LMTD, the pressure of the steam can be increased.

An obvious way to increase the LMTD is to raise the temperature of the primary fluid. However, in nuclear steam generating systems, the temperature of the primary fluid is a limiting factor in the design of the system and is normally set at a maximum allowable safe value.

Increasing the LMTD may also be accomplished within the steam generator by providing a preheater chamber in which feedwater is heated to a temperature lower than the boiling point. Examples of steam generators which include preheaters can be found in U.S. Pat. Nos. 3,804,069; 3,896,770 and 3,916,843. The increased complexity of a steam generator resulting from the addition of a preheater section increases the probability of excessive corrosion, increased sludge collection, and water hammer problems. The present invention combines the simplicity of a recirculating steam generator with the performance advantages of a preheat unit.

SUMMARY OF THE INVENTION

In general, a steam generator constructed in accordance with this invention utilizes a U-shaped bundle of tubes to provide the heat transfer surface required to transfer heat from a first fluid to vaporize a second fluid. A vertical shell portion encloses the tube bundle which is so disposed that the first fluid flows through the tubes, thereby creating a hot leg portion and a cold leg portion in the tube bundle. A tube sheet, for receiving the ends of the tube, is disposed near one end of the vertical shell portion. A wrapper which encloses the tube bundle is disposed within the vertical shell portion to form an annular downcomer passage. Conventional means for separating liquid from the vapor and for recirculating the separated liquid by directing it into the annular downcomer passage are provided. The annular downcomer passage is divided into two sections which are located adjacent to the cold leg and hot leg portons of the tube bundle, respectively. Incoming feedwater is introduced into the section of the downcomer passage which is adjacent to the cold leg portion of the tube bundle. Within that section of the downcomer passage, the feedwater is preheated by mixing with the recirculated separated fluid. The mixture of recirculated separated fluid and feedwater is then introduced into the cold leg portion of the tube bundle. A partition plate is provided between the hot leg and cold leg portions of the tube bundle to prevent the mixture on the cold leg side from mixing with the remainder of the recirculating fluid which enters the tube bundle on the hot leg side in the usual manner.

DESCRIPTION OF THE PREFERRED EMBODIMENT

Figure 1:
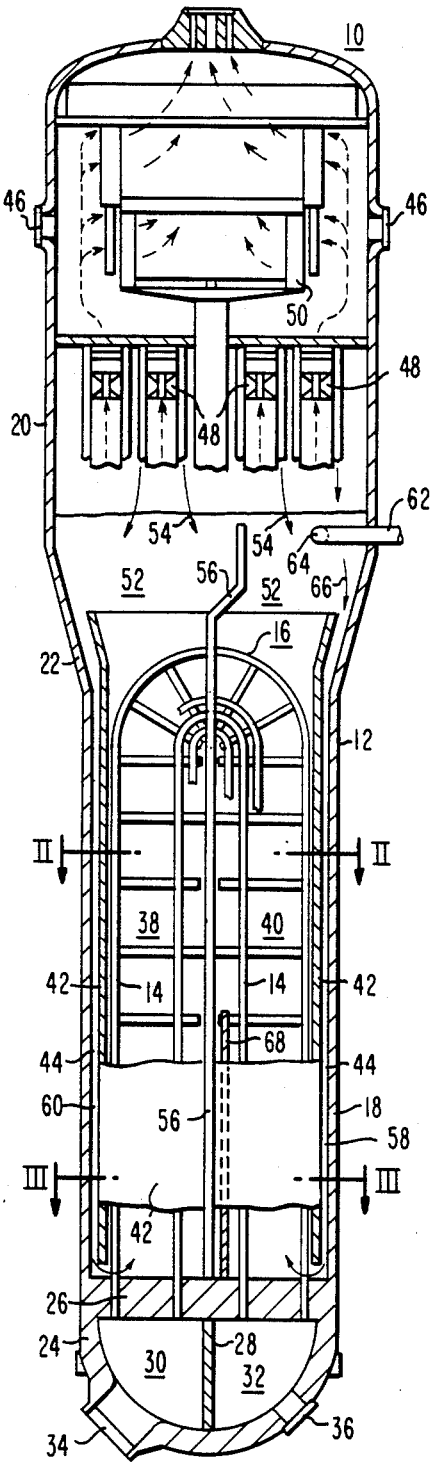
FIG. 1 is a vertical sectional view , partially in elevation, of a steam generator constructed in accordance with one embodiment of the present invention.

Referring to the drawings, FIG. 1 shows a steam or vapor generator 10 having a vertical shell portion 12 and a plurality of U-shaped tubes 14, forming a tube bundle 16 which is disposed within shell 12. The shell has a lower portion 18 having one diameter, an upper portion 20 having a larger diameter and a frustoconical portion 22 serving as a transition member between the upper and lower portions 20 and 18, respectively. The lower portion of the shell 18 is attached to a semi-spherical head portion 24. The head portion 24 has an integral tube sheet 26 which receives the ends of the U-shaped tubes 14. A dividing plate 28 separates the head 24 into two generally equal compartments 30 and 32. The inlet compartment 30, has an inlet nozzle 34 for primary fluid and the outlet compartment 32, has an outlet nozzle 36. Primary fluid entering through inlet nozzle 34 is directed through the U-tube bundle 16 such that a hot leg portion 38 and a cold leg portion 40 are created within the bundle.

A sleeve or wrapper 42 encloses the tube bundle and forms an annular chamber 44 between the wrapper 42 and the shell 12. Steam generated within the tube bundle 16 passes into the upper portion of the shell 20 and through various liquid separating means as shown by the dotted arrows. Two diametrically opposed manways 46 provide access to the interior of the upper portion of the shell which houses two separate moisture or liquid separators 48 and 50. The first separator 48 is a centrifugal type separator and comprises a plurality of riser tubes and swirl vanes as are commonly found in steam generators. The second moisture separator 50 comprises two groups of hook and pocket vane-type or chevron separators in accordance with known designs. Liquid separated by these moisture separators is recirculated by flowing into a liquid pool 52 as illustrated by solid arrows 54. The recirculated liquid is directed into annular downcomer passage 44. A divider plate 56 extends from the pool 52 down into the annular downcomer passage 44, thereby dividing the annular downcomer passage 44 into first and second sections 58 and 60, wherein section 58 lies adjacent to the cold leg portion 40 of the tube bundle 16, while the second section 60 lies adjacent to the hot leg portion 38 of the tube bundle 16.

A secondary fluid or water inlet 62 is provided with a feed ring or nozzle 64 and is disposed about the tube bundle such that inlet water is directed downward as shown by solid arrow 66 into the first section of the segmented annular downcomer passage. Existing feedwater inlet structures can be easily modified to accomplish list, for example, by placing all inlet J-tubes on one side of the feedwater ring. While traveling down that section, the feedwater is preheated by mixing with the recirculating liquid. At the bottom of the first section of the annular downcomer passage, the mixture is introduced into the cold leg side 40 of the tube bundle 16 by natural circulation. A partition plate 68 is provided between the hot leg 38 and cold leg 40 sides of the tube bundle to prevent mixing of the recirculated liquid/-feedwater mixture and the recirculated liquid which is introduced at the bottom of the hot leg side 38. This partition plate 68 extends from the tube sheet 26 to a preselected height within the tube bundle 16.

Figure 2:
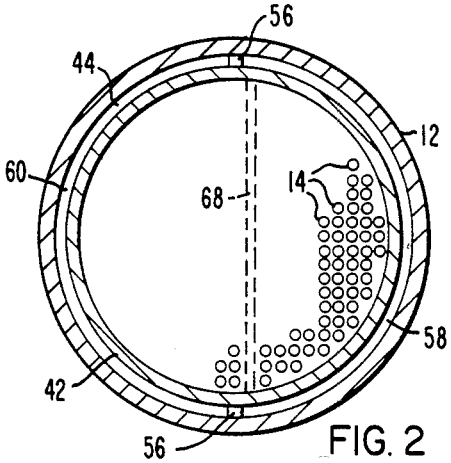
FIG. 2 is a cross section of the steam generator of FIG. 1 taken along line II—II.
Figure 3:
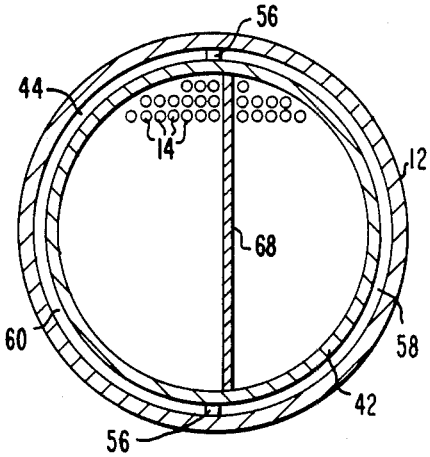
FIG. 3 is a cross section of the steam generator of FIG. 1 taken along line III—III.

FIGS. 2 and 3 are cross sections of the steam generator of FIG. 1 taken along lines II—II and III—III, respectively. In each of these Figures, divider 56 is shown to divide annular downcomer passage 44 into first and second sections 58 and 60, respectively. FIG. 3 illustrates that partition plate 68 extends diametricaly across the wrapper 42 in the lower portion of the tube bundle 16.

Mixing of feedwater with recirculating water reduces the mean temperature difference available in the preheater, which tends to decrease performance. However, this performance decrease is offset by the increased secondary side heat transfer coefficient in the preheater which results from higher mass velocities of the feedwater/recirculating water mixture. Calculations have shown that a steam generator operating at a steam pressure of about 1000 psi can achieve up to a 30 psi increase in pressure with this invention. Alternatively, the same performance can be achieved with a decrease in temperature of about 3° F. if this invention is used.

Therefore, the present invention can be seen to provide all of the advantages of a recirculating unit with the performance advantages of a preheat unit. Feedwater box structural design problems and cold feedwater contact with structural members are avoided. In addition, the feedwater inlet structure of this invention could be supplied as a replacement for existing feed ring units.

Although the present invention has been described in terms of what is at present believed to be the preferred embodiment, it will be apparent to those skilled in the art that various changes may be made to the preferred embodiment without departing from the scope of the invention. It is, therefore, intended that the appended claims cover all such changes.

I claim:

1. A vapor generator comprising:

a vertical shell portion;

a plurality of U-shaped tubes forming a tube bundle for transferring heat from a primary fluid to a secondary fluid, to vaporize said secondary fluid, said tube bundle being so disposed within said vapor generator that the primary fluid flows through the tubes to create a hot leg portion and a cold leg portion;

a tube sheet disposed adjacent to one end of said vertical shell portion, for receiving the ends of the tubes;

a wrapper, generally enclosing said tube bundle, and disposed within said shell portion to form an annular downcomer passage;

means for separating liquid from the vapor produced from said secondary fluid and for directing said separated liquid into said annular downcomer passage;

a divider plate extending longitudinally along said annular downcomer passage for dividing said annular downcomer passage into a first section adjacent to said cold leg portion of said tube bundle and a second section adjacent to said hot leg portion of said tube bundle; and means for introducing feedwater into said first section of said downcomer passage, wherein said feedwater mixes with said separated liquid, said wrapper being cooperatively associated with said shell portion such that the mixture of feedwater and separated liquid flows into said cold leg portion of said tube bundle;

wherein a top edge of said divider plate is offset toward said feedwater introducing means to limit the quantity of said separated liquid which mixes with said feedwater.

2. A vapor generator as recited in claim 1, further comprising:

a partition plate between the hot leg and cold leg portions of said tube bundle for preventing mixture of liquids which are introduced into said tube bundle from said first and second sections of said downcomer passage.

3. A vapor generator as recited in claim 2, wherein said partition plate extends from the tube sheet to a preselected point along said tube bundle.

4. A vapor generator as recited in claim 1, wherein said means for introducing feedwater comprises:

a feedwater inlet positioned adjacent to said tube bundle at an end opposite to the end of said tube bundle which passes through said tube sheet.

* * * * *